United States Patent [19]

Frost et al.

[11] Patent Number: 4,588,120

[45] Date of Patent: May 13, 1986

[54] APPARATUS AND METHOD FOR FORMING BELT LOOPS AND THE LIKE

[75] Inventors: Walter W. Frost; C. Ray Hamilton, both of Vidalia, Ga.

[73] Assignee: Oxford Industries, Inc., Vidalia, Ga.

[21] Appl. No.: 461,449

[22] Filed: Jan. 27, 1983

[51] Int. Cl.[4] ..... B27F 7/19

[52] U.S. Cl. ..... 227/76; 2/322; 227/84

[58] Field of Search ..... 2/243 R, 322; 227/20, 227/21, 22, 23, 24, 64, 66, 76, 84, 140, 156

[56] References Cited

U.S. PATENT DOCUMENTS

| | | | |
|---|---|---|---|
| 1,256,553 | 2/1918 | Grings | 227/20 |
| 1,400,843 | 12/1921 | Wilbur | 227/21 |
| 2,912,701 | 11/1959 | Vizard | 2/322 X |
| 4,318,555 | 3/1982 | Adamski et al. | 227/84 X |
| 4,356,947 | 11/1982 | Marshall et al. | 227/84 X |

*Primary Examiner*—Paul A. Bell
*Attorney, Agent, or Firm*—Jones & Askew

[57] ABSTRACT

Apparatus and method for cutting a continuous length of strip-like material into elongate strips and forming the strips into fastened loops such as belt loops and the like, including drawing means for drawing an amount of material from a supply, a cutter for cutting the drawn material into a strip of a predetermined length, grasping fingers for grasping the strip at the cutter and for transferring the strip to a forming area, a forming trough, mandrel and folding fingers which forms the strip into a loop, and a stapler for stapling the strip into a fastened loop. The operations of drawing the material from the supply and cutting the material into strips occur simultaneously with the steps of forming and stapling a previously-cut strip, so that high speeds of operation are possible.

30 Claims, 10 Drawing Figures

APPARATUS AND METHOD FOR FORMING BELT LOOPS AND THE LIKE

BACKGROUND

1. Field of the Invention

The present invention relates generally to apparatus and methods for forming fastened loops, and relates specifically to a system which automatically and continually forms belt loops and the like.

2. Description of the Prior Art

In the apparel belt-making industry, it has become common for manufacturers to provide near the belt buckle on a finished belt a fastened belt loop of a material compatible with the belting material. When the belt is buckled, the end of the belt which extends from the buckle may be placed under the belt loop so that the end lies close to the belt and does not stick out in an unattractive and sloppy manner. Commonly, belt loops of this type are of a diameter slightly larger than the width of the belt so that the belt and the end of the belt may both fit within the belt loop. Typically, the belt loop is attached to the belt by means of gluing, stapling, sewing, or the like.

Prior to the present invention, belt loops were made by hand by a worker who pulled a quantity of belting material from a supply and cut the material into strips of an appropriate length to provide the desired diameter. The strips were then folded by hand so that the ends were adjacent one another, and the worker then inserted the ends into a fastening device such as a stapler or sewing head so that the ends could be fastened together to form the fastened loop. Such manual assembly of fastened belt loops was necessarily slow and arduous work, in that a number of manual operations was required, including pulling the material from the supply, cutting the material with scissors or another type of cutter, folding the loop so that the ends were adjacent one another, and holding the loop while the fastening means attached the ends of the loop together to form the fastened loop.

SUMMARY OF THE INVENTION

Briefly described, the present invention comprises an apparatus and method for cutting a continuous length of strip-like material into elongate strips and forming the strips into fastened loops such as belt loops and the like. The apparatus disclosed herein draws an amount of the material from a supply, cuts the drawn material into an elongate strip having a predetermined length, forms the strip into a loop wherein one end of the strip is placed adjacent the other end on a mandrel, and fastens the ends of the strip together to form a fastened loop.

More particularly described, the apparatus includes a finger clamp which clamps the end of the material provided from the supply and thereafter moves away from the supply, pulling a predetermined amount of the material from the supply past a cutter. The finger clamp is operative to clamp the end of the material at a first position and then to pull the clamped end of the material past the cutter to a second position. The cutter then cuts the material into an elongate strip of a predetermined length. The apparatus further includes grasping fingers which grasp the material prior to the cut and slightly tension the material by lifting upwardly against the restraint of the finger clamp. After the cut is made, the grasping fingers move the cut strip to a forming trough and position the strip in the trough. The trough is then operative to press the strip into engagement with a mandrel so that the ends of the strip extend upwardly and out of the trough and about the sides of the mandrel. Folding fingers then engage the ends of the strip and press the ends about the top of the mandrel so that the ends are adjacent one another. A staple head then drives a staple into the adjacent ends of the strip by stapling between the folding fingers. The trough is then lowered away from the mandrel, and an ejector rapidly extends and ejects the completed fastened loop from the mandrel.

Still more particularly described, the apparatus includes a strip clamp which clamps the material during the movement of the finger clamp from its second position back to its first position. The grasping fingers, which engage the material between the finger clamp and the strip clamp, tension the material by lifting upward slightly against the resistance of the finger clamp and the material supply reel. After the cut is made, the finger clamp releases the cut strip so that the grasping fingers can move the cut strip to the trough. The strip clamp then engages with the material so that as the finger clamp moves toward the cut end of the material for reengagement with the end of the material, the end of the material will extend outwardly over a portion of the finger clamp against which the end of the material is pressed. This prevents any force being exerted against the supply of material from unthreading the material from the apparatus.

The grasping fingers of the disclosed apparatus comprises extendable and retractable grasping fingers which are mounted to a carriage, which in turn is movable along a track. The grasping fingers extend to grasp the material and retract with the cut strip; the carriage and grasping fingers and cut strip then move along the track towards the trough. The grasping fingers, upon reaching the trough area, extend toward the trough, place the cut strip in the trough, and retract away from the trough, leaving the cut strip in the trough. The trough then extends to force the cut strip into engagement with the mandrel, causing the ends of the strip to extend outwardly from the trough. A pair of folding fingers then descend upon the extended ends of the strip to fold the ends adjacent to one another. The disclosed embodiment is operative to fold one end of the strip against the top of the mandrel and then to fold the other end of the strip, so that fastened loops having ends in overlapping relationship can be formed. The folding fingers include a notched recess so that the stapler can drive a staple into the ends of the strip while the folding fingers hold the ends together. The folding fingers withdraw after the strip is fastened, and the ejector then kicks the fastened loop away from the mandrel.

Thus, it is an object of this invention to provide an expedient, automatic and accurate system for forming belt loops and the like.

Another object of the present invention is to provide an apparatus for forming fastened loops such as belt loops by drawing material from a continuous length of strip-like material, cutting the material into a strip having a predetermined length, forming the strip into a loop wherein the ends of the strip lie adjacent one another, and fastening the ends of the strip to form a completed fastened loop.

Another object of the present invention is to provide a method for rapidly and automatically making fastened loops such as belt loops and the like, wherein the operator provides a continuous length of strip-like material, adjusts for the desired size of belt loop, and then simply removes completed fastened loops at the output.

Another object of the present invention is to provide an apparatus and method for forming fastened loops which includes means and steps for cutting continuous strip-like material into strips of a predetermined length, moving the cut strips and placing them into a loop former which forms a loop of the strip wherein the ends of the strip are placed adjacent one another, fastening the ends of the strip together to form a fastened loop, and ejecting the fastened loop into a bin or receptacle.

These and other objects, features and advantages of the present invention may be more clearly understood and appreciated from a review of the following detailed description of the disclosed embodiment and by reference to the appended drawings and claims.

DETAILED DESCRIPTION OF THE PREFERRED EMBODIMENT

Figure 1:
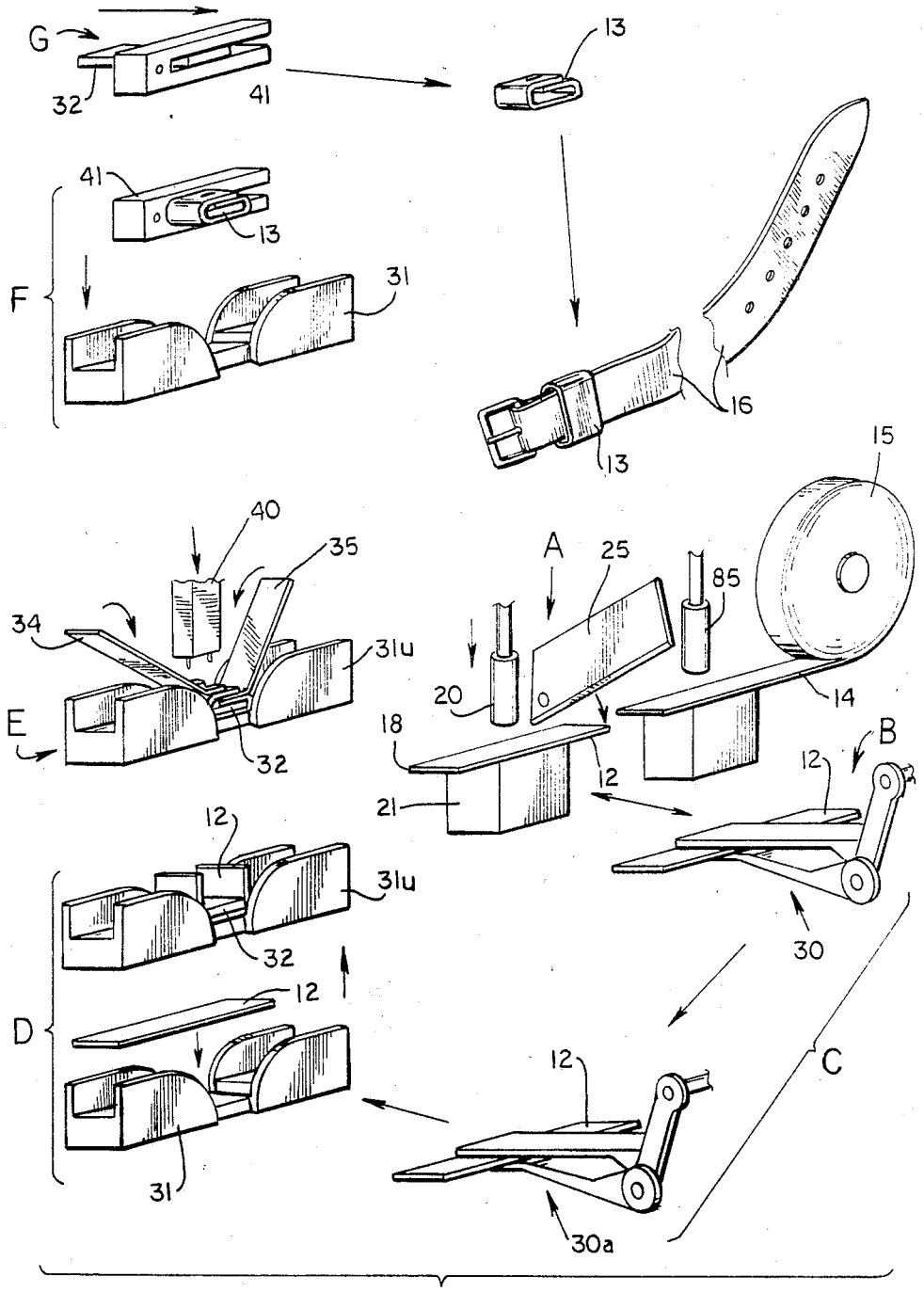
FIG. 1 is a schematic illustration of an apparatus and method embodying the present invention showing the steps of cutting continuous material into a strip, moving the strip to a trough, engaging the trough and strip with a mandrel, folding of the ends of the strip, and fastening the strip.

Referring now to the drawings, in which like numerals indicate like elements throughout the several views, FIG. 1 schematically illustrates the operation and method of the disclosed embodiment of the present invention. As schematically illustrated at step A, the end 18 of a continuous length of strip-like material 14 contained on a reel 15 is engaged by a finger clamp 20, which presses the end 18 against a finger clamp carriage 21. The finger clamp 20 and carriage 21 then pull an amount of material from the reel past a cutting blade 25 to a predetermined length. At step B, grasping fingers 30 extend towards the material and grasp the material between the finger clamp 20 and the cutting blade 25. Cutting blade 25 then cuts the material to form an elongate strip 12 having a predetermined length. The grasping fingers 30 then retract, carrying the strip 12. At step C, the grasping fingers then move to the position indicated at 30*a*, and then extend towards a forming trough 31, carrying the strip 12.

Elongate strip 12 is then placed into a forming trough 31, which is shown at step D in a lowered position. The forming trough then moves upwardly to the position indicated at 31*u*, thereby pressing the strip 12 about a mandrel 32. The ends of the strip 12 extend outwardly from the trough at 31*u* when the trough and strip are engaged with the mandrel.

At step E, folding fingers 34, 35 engage the ends of the strip and fold the ends about the top of mandrel 32. A staple head 40 then staples the ends of the strip to form a fastened loop.

At step F, the trough 31 descends to the lowered position, leaving a fastened loop 13 engaged about the mandrel. At step G, an ejector bar 41 moves along the mandrel 32 and ejects the fastened loop 13 therefrom.

The fastened loop 13 may then be affixed as a belt loop on a completed belt 16.

Figure 2:
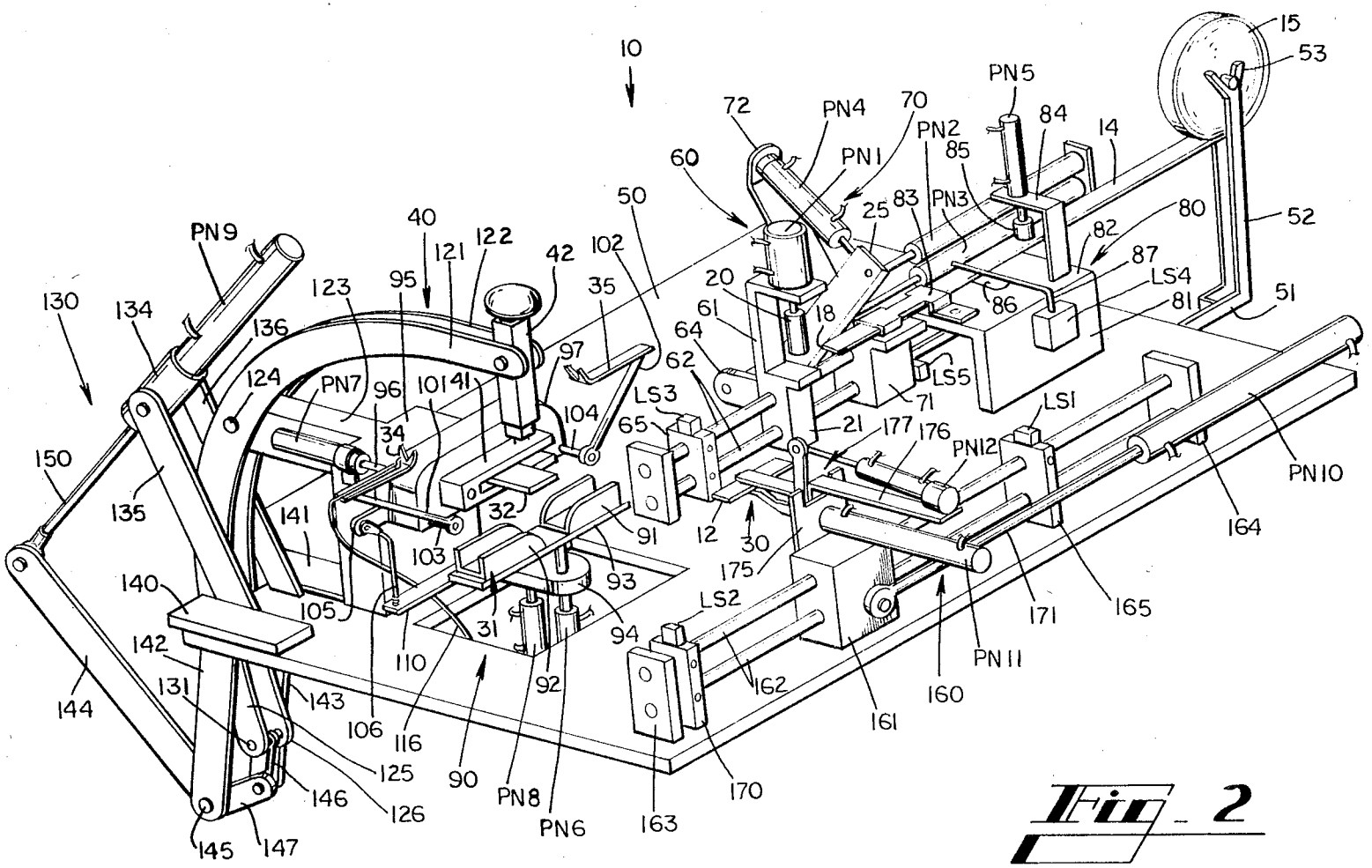
FIG. 2 is a pictorial illustration of an apparatus embodying the present invention.

As illustrated in FIG. 2, the preferred embodiment of the present invention comprises an apparatus 10 for forming belt loops, comprising a work table 50 which supports the various elements of the apparatus. The reel 15 of strip-like material 14 is mounted on a hanger structure 51 which includes an upright stanchion 52 and reel fork 53. When the reel 15 is mounted on the hanger structure 51, the free end 18 of the material 14 is fed onto work table 50 into the apparatus 10.

The end 18 is provided to a drawing means 60 which engages the end and pulls an amount of material 14 from the reel 15. Drawing means 60 comprises a finger clamp 20 which is mounted on a support member 61 to a finger clamp carriage 21. A pneumatic cylinder PN1 moves finger clamp 20 towards and away from finger clamp carriage 21 to engage and release the material. The carriage 21 may assume a first position, illustrated in FIGS. 9*a, f* for engagement with the end 18, or a second position, illustrated in FIGS. 9*b–e*, wherein an amount of material has been pulled from the supply.

Finger clamp carriage 21 moves along track bars 62 towards and away from the supply of material 14. When finger clamp carriage 21 assumes the first position towards the end 18 of the material with the finger clamp 20 in the up position, the end 18 may be pressed between the finger clamp 20 and the carriage 21 when pneumatic cylinder PN1 is actuated.

A pneumatic cylinder PN2 is mounted to work table 50 for movement of the finger clamp carriage 21 along track bars 62. The rod of pneumatic cylinder PN2 is affixed to an arm 64, which is in turn attached to finger clamp carriage 21. An adjustable carriage stop 65 mounted on track bars 62 is used to limit the excursion of finger clamp carriage 21 in the direction away from the reel 15, and thus sets the second position for the carriage. Limit switch LS3 mounted to stop 65 is actuated when carriage 21 is moved against the stop and provides a signal to the controller that the carriage has reached the second position.

A cutting means 70 cuts the material 14 after an amount thereof has been drawn from the reel by the drawing means 60. Cutting means 70 comprises cutting blade 25, which is pivotally mounted on a cutter carriage block 71. Cutter carriage block 71 is also mounted for movement along track bars 62 between a first position and a second position (see FIG. 9). In the first position, material 14 lies across the top of the cutter carriage so that the end 18 may be engaged by the finger clamp 20. In the second position, the cutter cuts the material to a predetermined length. A pneumatic cylinder PN3 mounted to work table 50 moves cutter carriage block 71 along the track bars 62 between positions. A limit switch LS5 mounted to work table 50, when actuated by the cutter carriage block, provides a signal to the controller that the cutter carriage block 71 is in the first position, at the extent of its allowed movement towards the reel 15.

Cutting means 70 further comprises a pneumatic cylinder PN4 which is mounted to a bracket 72, which in turn is attached to cutter carriage block 71. The rod of cylinder PN4 is affixed to the cutting blade 25. Actuation of cylinder PN4 causes the blade 25 to cut the material 14 into a strip.

Figure 3:
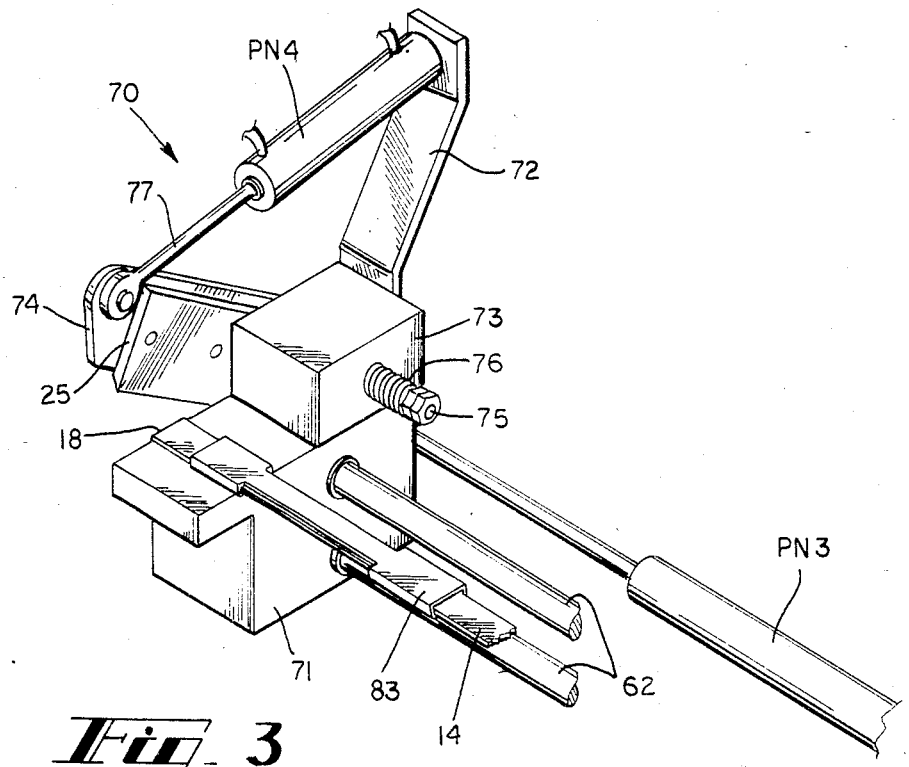
FIG. 3 is a pictorial illustration of the cutter carriage.

As best seen in FIG. 3, cutting means 70 further comprises a knife support block 73 which is attached to the top of cutter carriage block 71. Cutting blade 25 is removably attached to a pivotal blade support 74 so that the blade may be resharpened. Blade support 74 is pivotally mounted to knife support block 73 with a threaded axle 75 which passes through the knife support block 73 and is spring biased by spring 76 to aid in the return of the cutting blade 25 to the upward position. Cylinder rod 77 of pneumatic cylinder PN4 is connected to blade support 74 to drive the cutting blade 25 towards the material 14.

Returning to FIG. 2, material support means 80 mounted to work table 50 between the cutting means 70 and supply reel 15 supports the material 14 during the movement of drawing means 60 and cutting means 70 to their second positions. Material support means 80 comprises an L-bracket 81 which provides an upper surface 82 for supporting the material 14. A spring support 83, shown also in FIG. 3, is attached to the upper surface 82 and extends over the cutter carriage block 71 short of the path of blade 25 when the cutter carriage assumes its first position adjacent the support means 80. The end 18 of the material is supported by spring support 83. When cutting means 70 has moved to its first position closest to support means 80, the end 18 will extend a distance outwardly under blade 25 and may be engaged by finger clamp 20 when finger clamp carriage 21 is moved towards the support means 80 to assume its first position. The finger clamp 20 will then descend upon and grasp the end 18, and the drawing means 60 then pulls an amount of the material 14 from the reel 15 past the blade 25. These steps are more clearly illustrated in FIG. 9.

Still referring to FIG. 2, also mounted to the material support means 80 is a smaller L-bracket 84 which supports a strip clamp 85 and pneumatic cylinder PN5. Cylinder PN5 moves the strip clamp 85 towards and away from the upper surface 82 of L-bracket 81. The strip clamp 85 is engaged with the material 14 during the movement of the drawing means 60 and cutting means 70 away from their second positions back to their first positions so that the material 14 will not be displaced from spring support 83.

An elongate notch 86 is provided in the upper surface 82 of the L-bracket 81. A limit switch LS4 is attached to the L-bracket 81 and includes an actuator arm 87 which is disposed over the notch 86 and is supported when material 14 is present. When the supply of material 14 on reel 15 has been exhausted, actuator arm 87 will drop into the notch 86, thereby actuating LS4 and providing a signal to the controller that the supply of material 14 is exhausted.

Forming means 90 forms a cut strip of material into a loop and fastens the loop. Forming means 90 comprises a forming trough 31, which has a U-shaped cross section, into which the cut strip is received. Forming trough 31 comprises a pair of channel members 91, 92 which are attached to a horizontal support member 93 with a space between the two channel members 91, 92 to receive mandrel 32 when the trough is engaged with the mandrel. A support arm 94 is attached to the work table 50 and supports a pneumatic cylinder PN6 and the forming trough 31. Pneumatic cylinder PN6 moves the forming trough 31 upwards and downwards into and away from engagement with mandrel 32.

Mandrel 32 comprises a bar which is disposed over the forming trough 31. Mandrel 32 is rigidly attached to the front portion 97 of a stanchion 95 which is affixed to the work table 50. U-shaped ejector bar 41 is supported by the front portion 97 of stanchion 95 for movement along the mandrel so to eject a fastened loop away from the mandrel. A pneumatic cylinder PN7 is mounted upon stanchion 95 behind the front portion 97 so that when actuated the rod 96 passes through the front portion 97 to move the ejector bar 41 along the mandrel.

Folding fingers 34, 35 are also supported by the front portion 97 of stanchion 95. Arms 101, 102 carry the folding fingers 34, 35 and are mounted to pivot axles 103, 104, respectively. Pivot axles 103, 104 are supported for rotational movement in the front portion 97 of stanchion 95.

Figure 6:
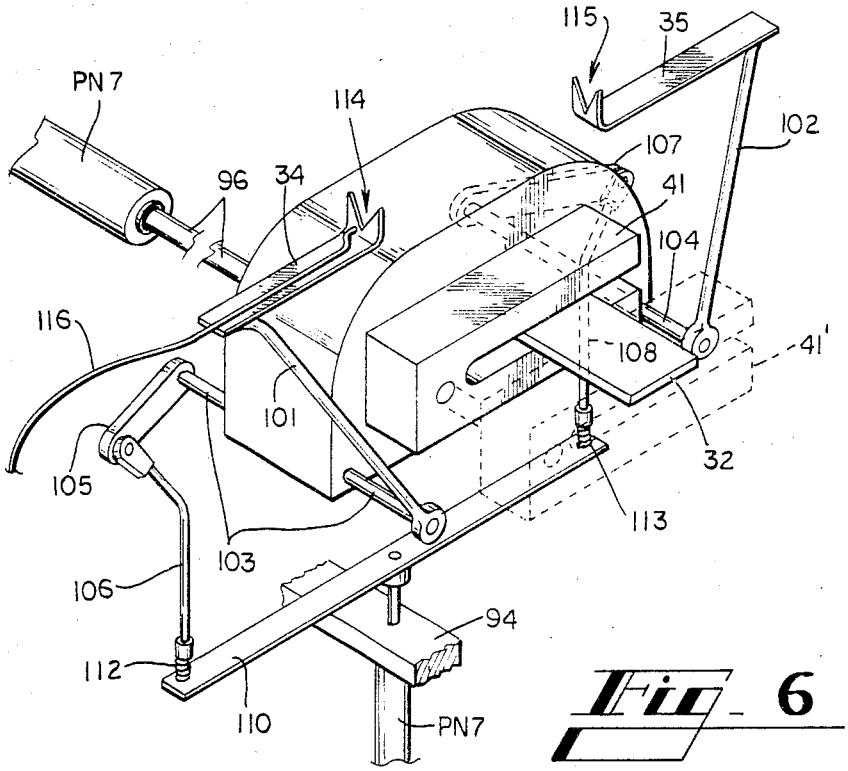
FIG. 6 is a partial pictorial illustration of the mandrel, loop ejector, and folding fingers.

As best illustrated in FIG. 6, pivot axle 103 has attached at one end thereof a crank arm 105 to which is attached a push rod 106. Similarly, pivot axle 104 has attached at one end a crank arm 106 which is connected to a push rod 108. Push rods 106, 108 extend downwardly and terminate atop a horizontal support beam 110 on damping springs 112, 113. A pneumatic cylinder PN8 mounted to support arm 94 moves support beam 110 upwardly and downwardly when actuated. When pneumatic cylinder PN8 extends, support beam 110 moves upwardly, imparting motion through springs 112, 113 to push rods 106, 108, causing crank arms 105, 107 to turn axles 103, 104. Arms 101, 102 then pivot and move folding fingers 34, 35 against the mandrel 32.

Also best illustrated in FIG. 6, the folding fingers 34, 35 include V-shaped notches 114, 115 which allow a staple to pass between the folding fingers and into the strip to fasten the loop. An air tube 116 is affixed to the top of folding finger 34 and directs a stream of air against the extended end of material to help insure that the end of the strip engaged by the folding finger 34 is pressed against the mandrel 32 prior to the end engaged by the folding finger 35, so that the ends of the strip overlap. This is assisted by the fact that crank arm 107 is slightly longer than crank arm 105, so that the folding finger 34 will engage its end of the strip before folding finger 35 engages the other end.

FIG. 6 also illustrates the movement of ejector bar 41 along mandrel 32 when cylinder PN7 actuates, causing the ejector bar to move to the position shown at 41' in dotted relief.

Returning now to FIG. 2, fastening means 40 are positioned on work table 50 so as to fasten the strip 12 into a fastened loop. Fastening means 40 comprises a staple head 42 which is disposed immediately above mandrel 32 for engagement with the strip after folding by folding fingers 34, 35. Staple head 42 is supported by a pair of arcuate support arms 121, 122 which are pivotally mounted by a pivot pin 124 to a rear portion 123 of stanchion 95. The lower ends 125, 126 of support arms 121, 122 extend beneath the plane of work table 50 and are pivotally connected to a driving means 130 by a pivot axle 131.

Driving means 130 causes support arms 121, 122 to pivot about pivot pin 124 and drive the staple head 42 downwardly to staple the ends of the strip. Driving means 130 comprises a pneumatic cylinder PN9 which is pivotally supported in a pivot housing 134 between a pair of parallel support arms 135, 136. Support arms 135, 136 extend upwardly from the plane of work table 50. Mounting bars 140, 141 are attached to the worktable 50 and are rigidly attached to support arms 135, 136 by welding or the like.

Driving means 130 further comprises a pair of downwardly-extending support arms 142, 143 which are also rigidly attached to mounting bars 140, 141. Supported for pivotal movement between support arms 142, 143 is an L-shaped lever arm 144, which pivots about a pivot pin 145 that is supported at the lower extremities of support arms 142, 143. A push rod 146 imparts motion from the movement of lever arm 144 to the arcuate support arms 121, 122. One end of push rod 146 is pivotally connected to the short leg 147 of lever arm 144, and the other end of the push rod is pivotally supported by pivot axle 131.

Figure 7:
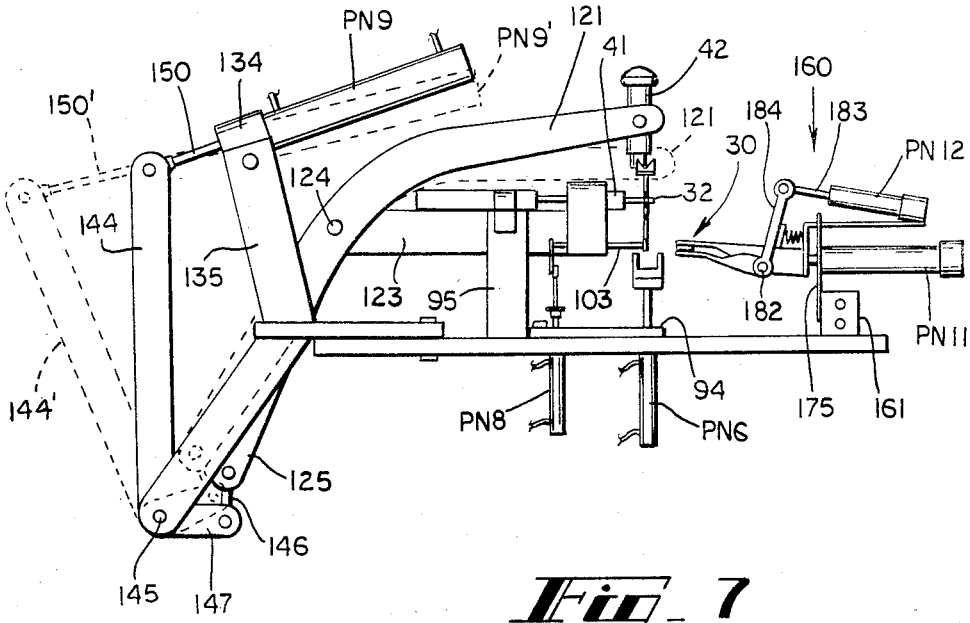
FIG. 7 is a side view of the forming and stapling means showing the relative placement of the grasping finger carriage.

As best illustrated in FIG. 7, when the cylinder rod 150 of pneumatic cylinder PN9 extends to the position shown at 150', lever arm 144 pivots to the position shown at 144', causing push rod 146 to push upwardly against the lower portion 125 of arcuate support arm 121, thereby driving the staple head 142 downwardly and towards mandrel 32, driving a staple into the loop of material. Support arm 121 moves to the position shown at 121' during this operation, and cylinder PN9 assumes the position shown at PN9'.

Referring again to FIG. 2, strip moving means 160 transfers the cut elongate strip 12 from the drawing means 60 and cutting means 70 to the fastening means 40. Moving means 160 comprises a carriage block 161 which travels along a pair of parallel track bars 162. Track bars 162 are supported by track bar supports 163, 164. A first carriage stop 165 positioned on track bars 162 towards drawing means 60 determines the extent of movement of carriage block 161 in a first position between drawing means 60 and cutting means 70. A limit switch LS1 mounted to carriage stop 165 is actuated when carriage block 161 assumes the first position and provides a signal to the controller of the presence of the carriage block at the first position.

A second carriage stop 170 is positioned along track bars 162 towards fastening means 40 and determines the extent of movement of carriage block 161 in a direction away from drawing means 60 and cutting means 70. Carriage stop 170 thus determines a second position for carriage block 161 which is disposed opposite fastening means 40. A limit switch LS2 mounted to carriage stop 170 is actuated when the carriage block is in this second position and provides a signal to the controller.

A pneumatic cylinder PN10 is mounted to work table 50 to move carriage block 161 along track bars 162. The cylinder rod 171 of pneumatic cylinder 10 is attached to carriage block 161.

Figure 4:
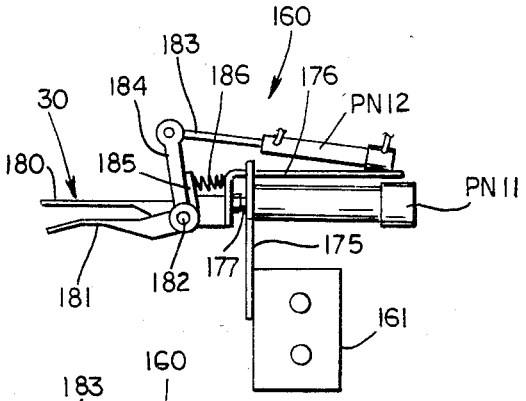
FIG. 4 is a side view of the grasping fingers in the retracted and open position.
Figure 5:
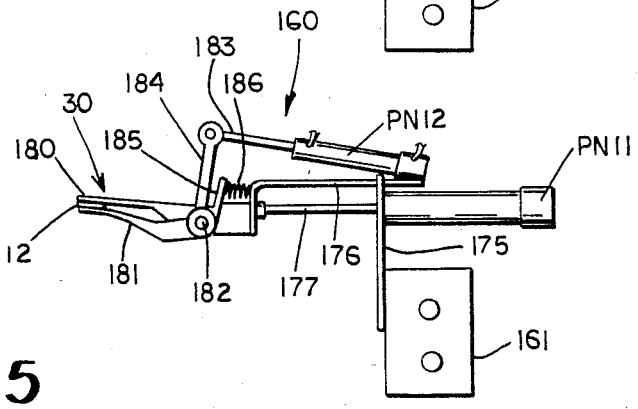
FIG. 5 is an end view of the grasping fingers in the extended and closed position.

As best illustrated in FIGS. 4 and 5, the strip moving means comprises grasping fingers 30 which extend and retract to grasp the strip 12 and place the strip at its destination in forming trough 31. FIG. 4 shows the grasping fingers 30 in the retracted position with the grasping fingers 30 opened, while FIG. 5 shows the extended position with the grasping fingers 30 closed about a strip of material 12.

The moving means 160 comprises a support bracket 175 which is mounted to carriage block 161 to support pneumatic cylinder PN11, which moves the grasping fingers 30 between the extended and retracted positions. An L-bracket 176 supports the end of cylinder rod 177 of pneumatic cylinder PN11 and also provides support for pneumatic cylinder PN12. As best seen in FIG. 2, support bracket 175 includes at the top a guide notch 177 which supports and guides L-bracket 176 as it travels between the extended and retracted positions.

Returning to FIGS. 4 and 5, the strip moving means 160 further comprises an upper grasping finger 180 and a lower grasping finger 181 which are pivotally connected at a pivot point 182. The cylinder rod 183 of pneumatic cylinder PN12 is connected to the upper end of a push arm 184, the lower end of which is pivotally connected to pivot point 182. When the cylinder rod 183 extends as shown in FIG. 4, push arm 184 causes the lower grasping finger 181 to move downwardly away from upper grasping finger 180. A spring mount 185 is connected to the lower grasping finger 181 and contains a spring 186 which biases the grasping fingers in the open position.

When the cylinder rod 183 of pneumatic cylinder PN12 is retracted as shown in FIG. 5, it pulls push arm 184 towards the pneumatic cylinder PN12 and brings lower grasping finger 181 upwardly towards the upper grasping finger 180 and then may grasp a strip 12 between the two fingers. Because of the pivotal mounting at 182 of upper grasping finger 180 and lower grasping finger 181, when the grasping fingers are closed, the strip 12 is slightly lifted above the plane at which the strip was grasped. The slight uplifting action is reversed into a downward action when the grasping fingers are opened. The up and down motion of the grasping fingers 30 insures that the strip 12 will be placed into the forming trough 31 and deposited therein. It will be appreciated that the preferable sequence of motion of the strip moving means 160 is to extend towards the strip with the grasping fingers open, close the grasping fingers 30 to grasp and slightly tension the material prior to cutting, retract away from the drawing and cutting means with a cut strip after cutting, extend towards the forming trough, and open the grasping fingers 30 to deposit the strip into the forming trough.

Figure 8:
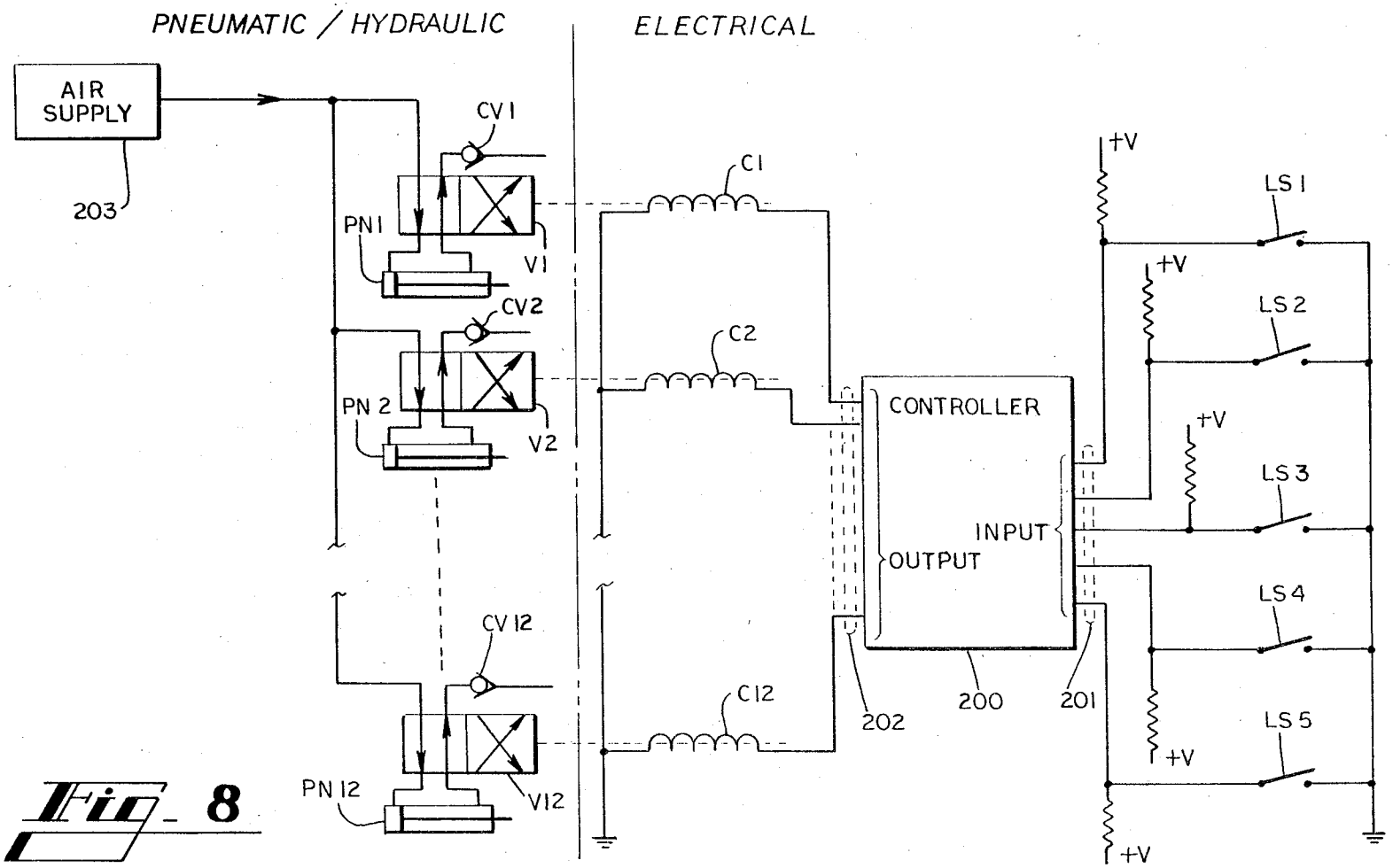
FIG. 8 is a schematic diagram of the electrical and pneumatic control system of the disclosed embodiment of the present invention.

FIG. 8 is a schematic diagram of the controller for the preferred embodiment of the present invention which controls the sequence of actuation and deactuation of the pneumatic cylinders. In the preferred embodiment, a programmable pneumatic sequence controller 200 which receives electrical inputs and provides signal outputs to actuate solenoid valves is employed instead of conventional pneumatic valve logic. The preferred embodiment employs a model SYSMAC-PO pneumatic sequence controller manufactured by Omron Electronics, Inc., of Schaumburg, Ill. Controller 200 receives its inputs on lines 201 from limit switches LS1–LS5 which are connected in the manner which will be known to those skilled in the art. The outputs of controller 200 are provided on lines 202 and drive the coils C1, C2, . . . C12 of solenoid valves V1, V2, . . . V12, respectively. Those skilled in the art will appreciate that solenoid valves V1, V2, . . . V12 comprise conventional pneumatic control valves which direct air pressure to alternate conduits from a supply 203 when actuated and deactuated. When in the deactuated condition, the valves direct pressure to drive pneumatic cylinders PN1, PN2, . . . PN12 in a first direction, while in the actuated position direct the pressure to drive the pneumatic cylinders in the opposite direction and causing the air within the opposite chamber of the cylinder to be exhausted through check valves CV1, CV2, . . . CV12.

OPERATION

Figure 9:
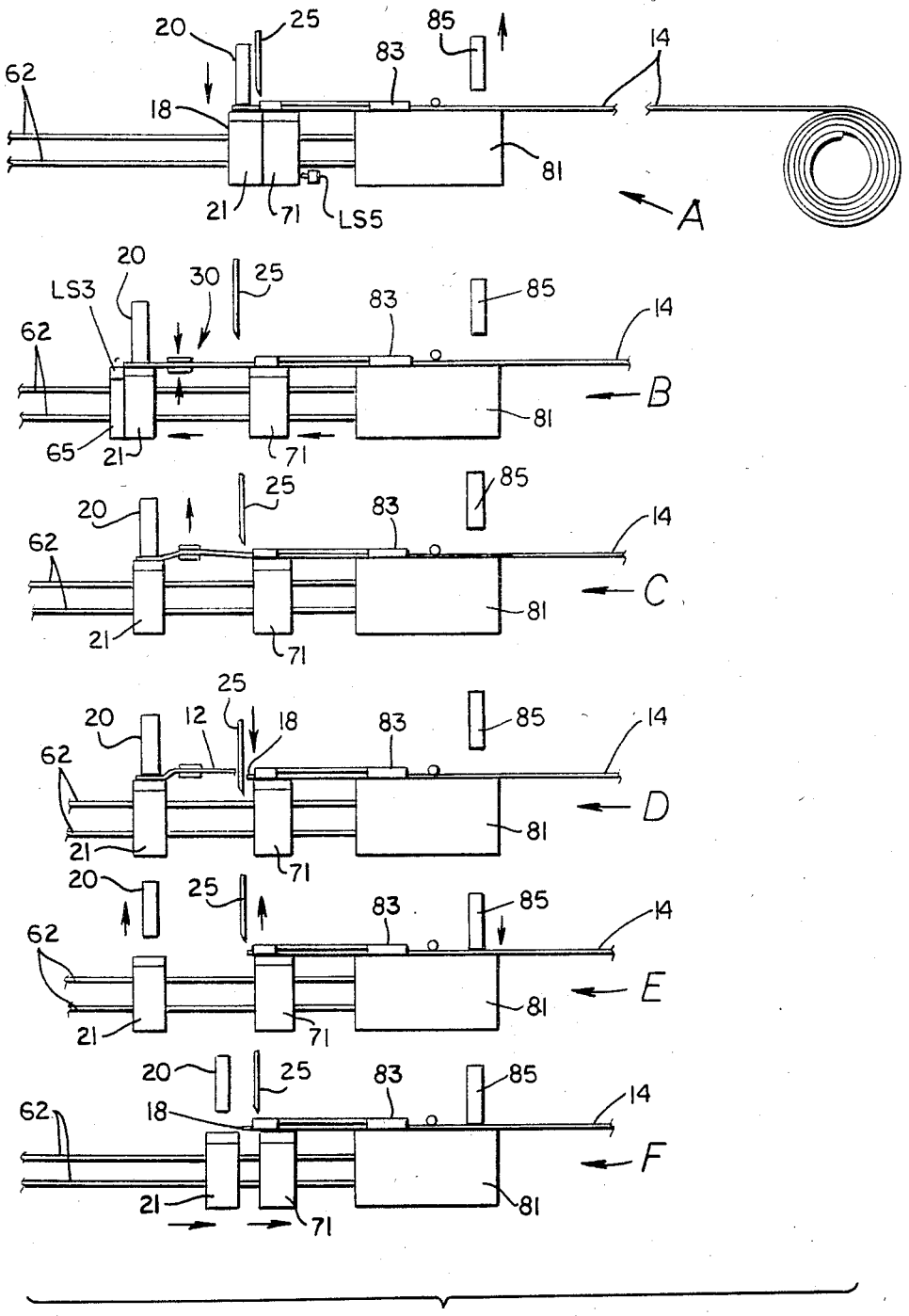
FIG. 9 is a schematic illustration of the steps of measuring and cutting the material into elongate strips.
Figure 10:
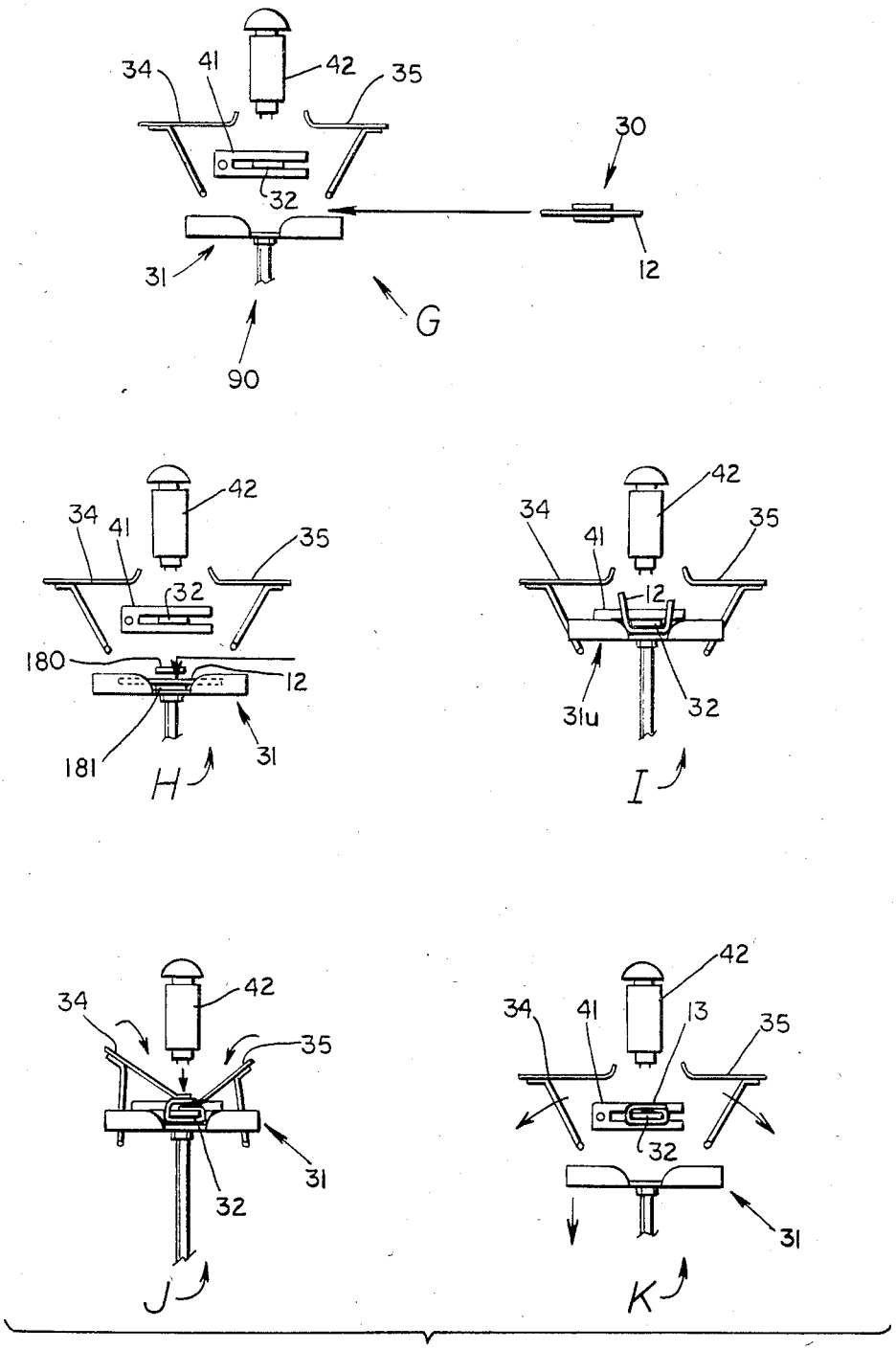
FIG. 10 is a schematic illustration of the steps of forming the loop, folding the ends, and fastening the ends.

FIGS. 9 and 10 schematically illustrate the sequence of steps performed by the preferred embodiment in practicing the method of the present invention. Referring first to FIG. 9, at step A, finger clamp carriage 21 and cutter carriage 71 are moved to their first positions closest to supply reel 15 by deactuation of cylinders PN2 and PN3. Limit switch LS5 is actuated by the presence of cutter carriage 71. The strip-like material 14 is provided through the spring support 83 so that the end 18 lies atop the finger clamp carriage 21. The sequence begins when cylinder PN1 is actuated, causing finger clamp 20 to clamp the end 18 of the material against the finger clamp carriage 21. The strip clamp 85 is in the raised position so that an amount of material may be drawn from the supply reel.

At step B, the finger clamp carriage 21 is moved along track bars 62 by cylinder PN2 until carriage stop 65 is encountered. Limit switch LS3 will be actuated by the finger clamp carriage 21 coming into proximity to the carriage stop. Cutter carriage block 71 is also moved along the track bar 62 by cylinder PN3 to the extent of its movement. It will now be appreciated that an amount of material is thereby drawn from the supply reel 15. The strip moving means 160 then extends towards the material and the grasping fingers 30 grasp the material by actuation of cylinders PN11 and PN12.

At step C, the grasping fingers 30 complete their closing action which slightly uplifts the material.

At step D, the cutting blade 25 is actuated by cylinder PN4, thereby cutting the material into an elongate strip 12 of a predetermined length. At step E, the cutting blade 25 is raised and the finger clamp 20 is lifted, thereby allowing the strip 12 to be withdrawn, and the strip clamp 85 is lowered against the material by actuating cylinder PN5. The grasping fingers 30 then retract, carrying the strip 12.

At step F, both the cutter carriage block 71 and the finger clamp carriage 21 move back towards their first position in the direction of the supply reel. The spring support 83 supports the end 18 so that as the finger clamp carriage moves underneath the end, the end will be supported above the finger clamp carriage so that the finger clamp 20 can descend and clamp against the material.

Turning now to FIG. 10, upon actuation of cylinder PN10 the grasping fingers 30 carry the elongate strip 12 away from the drawing means 60 and cutting means 70 towards the forming means 90 at step G. At step H, when the grasping fingers 30 are positioned directly adjacent the forming trough 31, the grasping fingers extend towards the forming trough 31 and the strip 12 is thus positioned directly above the forming trough 31. The grasping fingers then open, and the downward movement of both upper and lower grasping finger 180, 181 when the fingers open places the strip 12 into the trough. The grasping fingers then retract, leaving the strip in the trough.

At step I, the trough 31 is raised to the upward position 31*u* by actuating cylinder PN6, and the strip 12 is pressed against the mandrel 32, causing the ends of the strip to protrude above the trough 31.

At step J, folding fingers 34, 35 engage the ends of the strip 12 and fold one end over the other so as to form a loop. Staple head 42 is driven downwardly by cylinder PN9 towards the mandrel and strip and staples the strip together.

At step K, the trough 31 is lowered, and folding fingers 34, 35 are pivoted away from the mandrel 32, leaving a fastened loop 13 supported on the mandrel. Cylinder PN7 actuates and ejector bar 41 then ejects the fastened loop 13 outwardly and away from the mandrel.

It will be appreciated that certain steps of the sequence of operations shown in FIGS. 9 and 10 may be employed simultaneously. As soon as the grasping fingers 30 have begun to move the strip away from the drawing means and cutting means towards the forming means to begin the steps shown in FIG. 10, the movement of the finger clamp carriage 21 and cutter carriage block 71 step E in FIG. 9 toward the supply to cut another strip may immediately be begun. It will be further appreciated that an embodiment wherein the strip 12 after cutting is immediately placed into the forming trough may also be constructed, thereby eliminating the strip moving means 160 and replacing same with means for insuring accurate placement of the strip into the trough. Those skilled in the art will understand how the sequence of steps illustrated in FIGS. 9 and 10 may be programmed into central controller 200.

It will now be appreciated that there has been disclosed an apparatus which automatically and continually forms belt loops and the like by drawing a length of strip-like material from a supply, cutting the material into elongate strips of a predetermined length, forming the cut strips into a loop wherein the ends of the strip are placed adjacent one another, and fastening the ends of the strip together to form a fastened loop. It will also be appreciated that there has been disclosed a method for forming fastened loops wherein a length of strip-like material is drawn from a supply, the material is cut into an elongate strip of a predetermined length, the strip is placed into a trough which is moved into engagement with a mandrel so that the ends of the strip extend outwardly from the trough, the ends of the strip are folded so that the ends lie adjacent one another along the mandrel, and the ends of the strip are fastened together to form a fastened loop.

The preferred embodiment of the present invention has been disclosed by way of example and it will be understood that other modifications may occur to those skilled in the art without departing from the scope and the spirit of the appended claims.

We claim:

1. Apparatus for cutting a continuous length of strip-like material into elongate strips and forming the strips into independent fastened loops such as belt loops and the like, comprising:

means for drawing the material from a supply;

means for cutting the drawn material into an elongate strip of a predetermined length;

means for forming said strip into a generally u-shape with the ends of said strip extending outwardly;

folding means for engaging said outwardly extending ends of said strip and for folding said ends adjacent each other to form a loop wherein an end of said strip is adjacent the other end;

means defining an opening in said folding means for receiving a fastener; and means for fastening said ends of said strip through said opening in said folding means to form a fastened loop.

2. The apparatus of claim 1, wherein said drawing means comprises clamping means for clamping an end of the material, said clamping means being thereafter operative for pulling a predetermined amount of the material from the supply past said cutting means.

3. The apparatus of claim 2, wherein said clamping means is operative to clamp the end of the material at a first position, draw the material from said supply while moving from said first position to a second position, and release said strip after said cutting means has cut the material.

4. The apparatus of claim 2, further comprising second clamping means for clamping the material after said clamping means has moved from said first position to said second position.

5. The apparatus of claim 4, wherein said second clamping means holds the material while said clamping means returns from said second position to said first position.

6. The apparatus of claim 4, wherein said cutting means cuts the material while said clamping means and said second clamping means holds the material.

7. The apparatus of claim 1, further comprising strip moving means for moving said strip from said cutting means to said forming means.

8. The apparatus of claim 7, wherein said strip moving means comprises extendable and retractable grasping means, said grasping means operative to extend towards the material, grasp the material prior to cutting by said cutting means, retract away from the material carrying said strip after said cutting means has cut the material, extend towards said forming means after said strip moving means has moved from said cutting means to said forming means, and release said strip at said forming means.

9. The apparatus of claim 7, wherein said strip moving means comprises grasping finger means for grasping the material, and further comprising extension means for extending said grasping finger means to a first position and retracting said grasping finger means to a second position.

10. The apparatus of claim 9, further comprising carriage means for moving said grasping finger means and said extension means to a first carriage position adjacent said cutting means and a second carriage position adjacent said forming means.

11. The apparatus of claim 10, wherein said extension means is operative to extend said grasping finger means towards the material to said first position when said carriage means assumes said first carriage position, and is thereafter operative to retract said grasping finger means away from the material to said second position.

12. The apparatus of claim 11, wherein said extension means is operative to extend said grasping finger means towards said forming means to said first position when said carriage means assumes said second carriage position, and is thereafter operative to retract said grasping finger means away from said forming means to said second position.

13. The apparatus of claim 1, wherein said forming means comprises elongate trough means for receiving said strip and a bar mandrel, said trough means including a recess for receiving said bar mandrel, said trough means being operative to lift said strip into engagement with said bar mandrel so that said bar mandrel is received in said recess of said trough means and said ends of said strip extend upwardly from said trough means about the sides of said bar mandrel, and said folding means being operative to fold said ends of said strip about the top of said bar mandrel.

14. The apparatus of claim 13, wherein said folding means comprises a first folding finger positioned to one side of said bar mandrel and a second folding finger positioned to the other side of said bar mandrel, said first and said second folding fingers assuming a first position spaced away from said bar mandrel while said trough means is lifting said strip into engagement with said bar mandrel and assuming a second position wherein said ends of said strip are placed in adjacent relationship by said folding fingers after said strip has been lifted into engagement with said bar mandrel.

15. The apparatus of claim 14, wherein said fastening means comprises a stapler positioned above said bar mandrel, and wherein said first folding finger and said second folding finger each include a notch for allowing a staple from said stapler to fasten said strip when said folding fingers assume said second position where said ends of said strip are placed in ajacent relationship.

16. The apparatus of claim 1, further comprising ejecting means for ejecting said fastened loop from said folding means.

17. The apparatus of claim 16, wherein said ejecting means comprises extendable and retractable means positioned adjacent said bar mandrel, said means extending along said bar mandrel and pushing said fastened loop off of said bar mandrel.

18. The apparatus of claim 1, wherein said fastening means comprises a stapler positioned adjacent to said folding means.

19. Apparatus for cutting a continuous length of strip-like material into elongate strips and for making the strips into fastened loops such as belt loops and the like, comprising:

means for receiving a supply of strip-like material;

elongate first track means;

a first clamping carriage movable on said first track means between a first position towards said supply and a second position away from said supply;

a clamp affixed to said first clamping carriage for engaging the material when said first clamping carriage assumes said first position and for drawing a predetermined amount of the material from said supply as said first clamping carriage moves to said second position;

a cutter positioned adjacent said predetermined amount of the material for cutting the material into elongate strips of a predetermined length;

elongate second track means;

a second clamping carriage movable on said second track means between a first position adjacent to said cutter and a second position away from said cutter;

grasping means affixed to said second clamping carriage for grasping said elongate strip at said first position of said second clamping carriage and for moving said elongate strip to said second position of said second clamping carriage;

mandrel means positioned adjacent said second position of said second clamping carriage for receiving said elongate strip and for bending said elongate strip into a substantially U-shape;

folding means for engaging the ends of said elongate strip at said mandrel means and for placing the ends into adjacent relationship, thereby forming a loop; and fastening means for affixing the ends of said elongate strip together to form a fastened loop.

20. The apparatus of claim 19, further comprising ejector means for removing said fastened loop from said mandrel means.

21. The apparatus of claim 19, further comprising air blowing means affixed to said folding means for causing one of the ends of said elongate strip to lie beneath the other end when said folding means engages the ends to form said loop.

22. Apparatus for cutting a continuous length of strip-like material into elongate strips and forming the strips into fastened loops such as belt loops and the like, comprising:

means for drawing the material from a supply;

means for cutting the drawn material into an elongate strip of a predetermined length;

means for forming said strip into a loop wherein an end of said strip is adjacent the other end;

strip moving means for moving said strip from said cutting means to said forming means, said strip moving means comprising extendable and retractable grasping means operative to extend toward the material, grasp the material prior to cutting by said cutting means, retract away from the material carrying said strip after said cutting means has cut the material, extend towards said forming means after said strip moving means has moved from said cutting means to said forming means, and release said strip at said forming means; and means for fastening said end of said strip to said other end at said forming means to form a fastened loop.

23. Apparatus for cutting a continuous length of strip-like material into elongate strips and forming the strips into fastened loops such as belt loops and the like, comprising:

means for drawing the material from a supply;

means for cutting the drawn material into an elongate strip of a predetermined length;

means for forming said strip into a loop wherein an end of said strip is adjacent the other end;

strip moving means for moving said strip from said cutting means to said forming means, said strip moving means comprising grasping finger means for grasping the material and extension means for extending said grasping finger means to a first position for grasping the material and retracting said grasping finger means to a second position for carrying said strip; and means for fastening said end of said strip to said other end at said forming means to form a fastened loop.

24. The apparatus of claim 23, further comprising carriage means for moving said grasping finger means and said extension means to a first carriage position adjacent said cutting means and a second carriage position adjacent said forming means.

25. The apparatus of claim 24, wherein said extension means is operative to extend said grasping finger means towards the material to said first position when said carriage means assumes said first position, and is thereafter operative to retract said grasping finger means away from the material to said second position.

26. The apparatus of claim 25, wherein said extension means is operative to extend said grasping finger means toward said forming means to said first position when said carriage means assumes said second carriage position, and is thereafter operative to retract said grasping finger means away from said forming means to said second position.

27. Apparatus for cutting a continuous length of strip-like material into elongate strips and forming the strips into fastened loops such as belt loops and the like, comprising:

means for drawing the material from a supply;

means for cutting the drawn material into an elongate strip of a predetermined length;

means for forming said strip into a loop wherein an end of said strip is adjacent the other end, said forming means comprising elongate trough means for receiving said strip, a bar mandrel, and folding means, said trough including a recess for receiving said bar mandrel, said trough means being operative to lift said strip into engagement with said bar mandrel so that said bar mandrel is received in said recess of said trough means and said ends of said strip extend upwardly from said trough means about the sides of said bar mandrel, and said folding means being operative to fold said ends of said strip about the top of said bar mandrel; and means for fastening said end of said strip to said other end at said forming means to form a fastened loop.

28. The apparatus of claim 27, wherein said folding means comprises a first folding finger positioned to one side of said bar mandrel and a second folding finger positioned to the other side of said bar mandrel, said first and said second folding fingers assuming a first position spaced away from said bar mandrel while said trough means is lifting said strip into engagement with said bar mandrel and assuming a second position wherein said ends of said strip are placed in adjacent relationship by said folding fingers after said strip has been lifted into engagement with said bar mandrel.

29. The apparatus of claim 27, wherein said fastening means comprises a stapler positioned above said bar mandrel, and wherein said first folding finger and said second folding finger each include a notch for allowing a staple from said stapler to fasten said strip when said folding fingers assume said second position where said ends of said strip are placed in adjacent relationship.

30. In an apparatus for stapling loops of pliable material, an improved apparatus for forming separate independent fastened loops, comprising:

a bar mandrel;

an elongate trough for receiving a strip of pliable material and a recess for receiving said bar mandrel, said trough being movable between a first position away from said bar mandrel and a second position engaged with said bar mandrel;

means for moving said trough into engagement with said bar mandrel so that the ends of a strip of material placed in said trough extend outwardly from said trough;

folding finger means movable into engagement with the outwardly extending ends of said strip from said trough to move the ends of said strip into adjacent relationship about a surface of said bar mandrel;

means defining a staple-receiving notch in said folding finger means when said folding finger means place the ends of said strip in adjacent relationship; and stapling means operative to staple the ends of said strip by inserting a staple through said notch means.

* * * * *